US011840992B2

(12) United States Patent
Biller et al.

(10) Patent No.: US 11,840,992 B2
(45) Date of Patent: Dec. 12, 2023

(54) EGR PUMP SYSTEM WITH OVERHUNG ROTORS

(71) Applicant: Eaton Intelligent Power Limited, Dublin (IE)

(72) Inventors: Brandon Dennis Biller, Hazel Park, MI (US); Jim Kevin Spring, Brighton, MI (US); Douglas Anthony Hughes, Novi, MI (US); Joshua Kreucher, Washington Township, MI (US); Kevin Snyder, Marshall, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 100 days.

(21) Appl. No.: 17/607,671

(22) PCT Filed: Apr. 30, 2020

(86) PCT No.: PCT/EP2020/025201

§ 371 (c)(1),
(2) Date: Oct. 29, 2021

(87) PCT Pub. No.: WO2020/221478

PCT Pub. Date: Nov. 5, 2020

(65) Prior Publication Data

US 2022/0213852 A1 Jul. 7, 2022

Related U.S. Application Data

(60) Provisional application No. 62/841,489, filed on May 1, 2019.

(51) Int. Cl.
*F02M 26/34* (2016.01)
*F01M 9/10* (2006.01)
(Continued)

(52) U.S. Cl.
CPC ..... *F02M 26/34* (2016.02); *F01M 9/10* (2013.01); *F01M 11/02* (2013.01); *F04C 18/126* (2013.01);
(Continued)

(58) Field of Classification Search
CPC .. F02M 26/34; F02M 26/49; F02M 2026/004; F02M 26/05; F02M 26/47;
(Continued)

(56) References Cited

U.S. PATENT DOCUMENTS 6,435,166 B1 * 8/2002 Sato ..... F02M 26/05 123/568.21
2017/0313445 A1* 11/2017 Marshall ..... F16F 15/3156
2018/0045109 A1* 2/2018 Fortini ..... F02D 41/0087

FOREIGN PATENT DOCUMENTS

EP 1811181 A1 7/2007
JP 2006214380 A * 8/2006 ..... F01C 17/02
JP 2006214380 A 8/2006

OTHER PUBLICATIONS

International Search Report and Written opinion dated Jul. 1, 2020 pertaining to PCT Application No. PCT/EP2020/025201 filed Apr. 30, 2020.

* cited by examiner

*Primary Examiner* — Syed O Hasan
(74) *Attorney, Agent, or Firm* — Merchant & Gould P.C.

(57) ABSTRACT

An exhaust gas recirculation pump system for an internal combustion engine includes an EGR gas source and an electric motor assembly. A roots device is coupled to the electric motor. The roots device includes a housing defining an internal volume wherein the housing includes a radial inlet port receiving the EGR gas source and an outlet port expelling the EGR gas from the housing. Rotors are disposed in the internal volume and connected to the electric
(Continued)

motor. A transmission housing is attached to the housing. The transmission housing includes journals formed therein receiving bearings that support the rotors on only a single end of the rotors.

29 Claims, 18 Drawing Sheets

(51) Int. Cl.
*F01M 11/02* (2006.01)
*F04C 18/12* (2006.01)

(52) U.S. Cl.
CPC ..... *F04C 2240/30* (2013.01); *F04C 2240/40* (2013.01)

(58) Field of Classification Search
CPC ..... F01M 9/10; F01M 11/02; F04C 18/126; F04C 2240/30; F04C 2240/40
See application file for complete search history.

EGR PUMP SYSTEM WITH OVERHUNG ROTORS

FIELD OF THE INVENTION

The invention relates to exhaust gas recirculation (EGR) pumps and control of EGR pumps.

BACKGROUND OF THE INVENTION

There are many previously known automotive vehicles that utilize internal combustion engines such as diesel, gas or two stroke engines to propel the vehicle. In some constructions EGR (exhaust gas recirculation) recirculates the exhaust gas into the engine for mixture with the cylinder charge. The EGR that is intermixed with the air and fuel to the engine enhances the overall combustion of the fuel. This, in turn, reduces exhaust gas emissions.

By including a separate EGR pump an increase in fuel economy may be achieved in comparison to prior art systems that may use a turbocharger to drive an EGR flow with the addition of costly EGR valves. Additionally, a separate EGR pump provides full authority of the EGR flow rate. In a diesel application, a separate EGR pump may allow for removal of an EGR valve and replace a complicated variable geometry turbocharger with a fixed geometry turbocharger optimized for providing a boosted air charge. The separate EGR pump may provide reduced engine pumping work and improved fuel economy.

One disadvantage of intermixing exhaust gas is that the exhaust gas contains particulate matter such as soot. Water vapor may be included in exhaust gases from an engine as a result of the combustion process of fuel supplied to the engine. Generally, the water vapor is expelled to the environment through an exhaust system. However in an EGR application a portion of the exhaust is recirculated to the engine intake manifold. The water vapor may provide a carrier for particulate matter such as soot. Soot deposits may accumulate on various components degrading performance.

It is therefore desirable to provide an EGR pump that resists accumulation of soot deposits. It is also desirable to provide a separate EGR pump that transports EGR gases to prevent degradation of the additional components such as a supercharger or turbocharger.

Various portions of EGR pumps may be exposed to exhaust gases at elevated temperatures. For example the rotors associated with the pump may contact exhaust gases at temperatures such as from 220 to 300 C. In such a scenario, the high temperature may demagnetize the components of the electric motor causing a loss of torque. Additionally, the high temperature may adversely affect the mechanical components of the EGR pump such as varying the heat treatments and properties of the materials.

It is therefore desirable to reduce heat transfer from the EGR pump rotors to the electric motor that drives the EGR pump. There is therefore a need in the art to thermally isolate rotors of an EGR pump from an electric motor that may drive the pump such that the motor does not overheat.

Further, it is desirable to cool and lubricate the various components of the EGR pump for safe and long operation in an EGR environment.

SUMMARY OF THE INVENTION

In one aspect there is disclosed, an exhaust gas recirculation pump system for an internal combustion engine that includes an EGR gas source and an electric motor assembly.

A roots device is coupled to the electric motor. The roots device includes a housing defining an internal volume wherein the housing includes a radial inlet port receiving the EGR gas source and an outlet port expelling the EGR gas from the housing. Rotors are disposed in the internal volume and connected to the electric motor. A transmission housing is attached to the housing. The transmission housing includes journals formed therein receiving bearings that support the rotors on only a single end of the rotors.

In another aspect, there is disclosed an exhaust gas recirculation pump system for an internal combustion engine that includes an EGR gas source and an electric motor assembly. A roots device is coupled to the electric motor. The roots device includes a housing defining an internal volume wherein the housing includes a radial inlet port receiving the EGR gas source and an outlet port expelling the EGR gas from the housing. Rotors are disposed in the internal volume and connected to the electric motor. A transmission housing is attached to the housing. The transmission housing includes a lip seal disposed therein. The lip seal is movable in response to a pressure differential to contact an oil slinger or rotor sealing a rotor cavity from a bearing cavity.

In a further aspect, there is disclosed an exhaust gas recirculation pump system for an internal combustion engine that includes an EGR gas source and an electric motor assembly. A roots device is coupled to the electric motor. The roots device includes a housing defining an internal volume wherein the housing includes a radial inlet port receiving the EGR gas source and an outlet port expelling the EGR gas from the housing. Rotors are disposed in the internal volume and connected to the electric motor. A transmission housing is attached to the housing. The transmission housing includes journals formed therein receiving bearings that support the rotors on only a single end of the rotors. The bearings include a spacer assembly positioned in a bearing bore between the bearings. The spacer assembly includes an inner spacer spaced radially from an outer spacer.

In another aspect, there is disclosed an exhaust gas recirculation pump system for an internal combustion engine that includes an EGR gas source and an electric motor assembly. A roots device is coupled to the electric motor. The roots device includes a housing defining an internal volume wherein the housing includes a radial inlet port receiving the EGR gas source and an outlet port expelling the EGR gas from the housing. Rotors are disposed in the internal volume and connected to the electric motor. A transmission housing is attached to the housing. The transmission housing includes journals formed therein receiving bearings that support the rotors on only a single end of the rotors. The housing includes a bushing attached thereon. The bushing is positioned to support an inner diameter of a hole bored in the rotor only during a deflection of the rotor.

DETAILED DESCRIPTION

Figure 1:
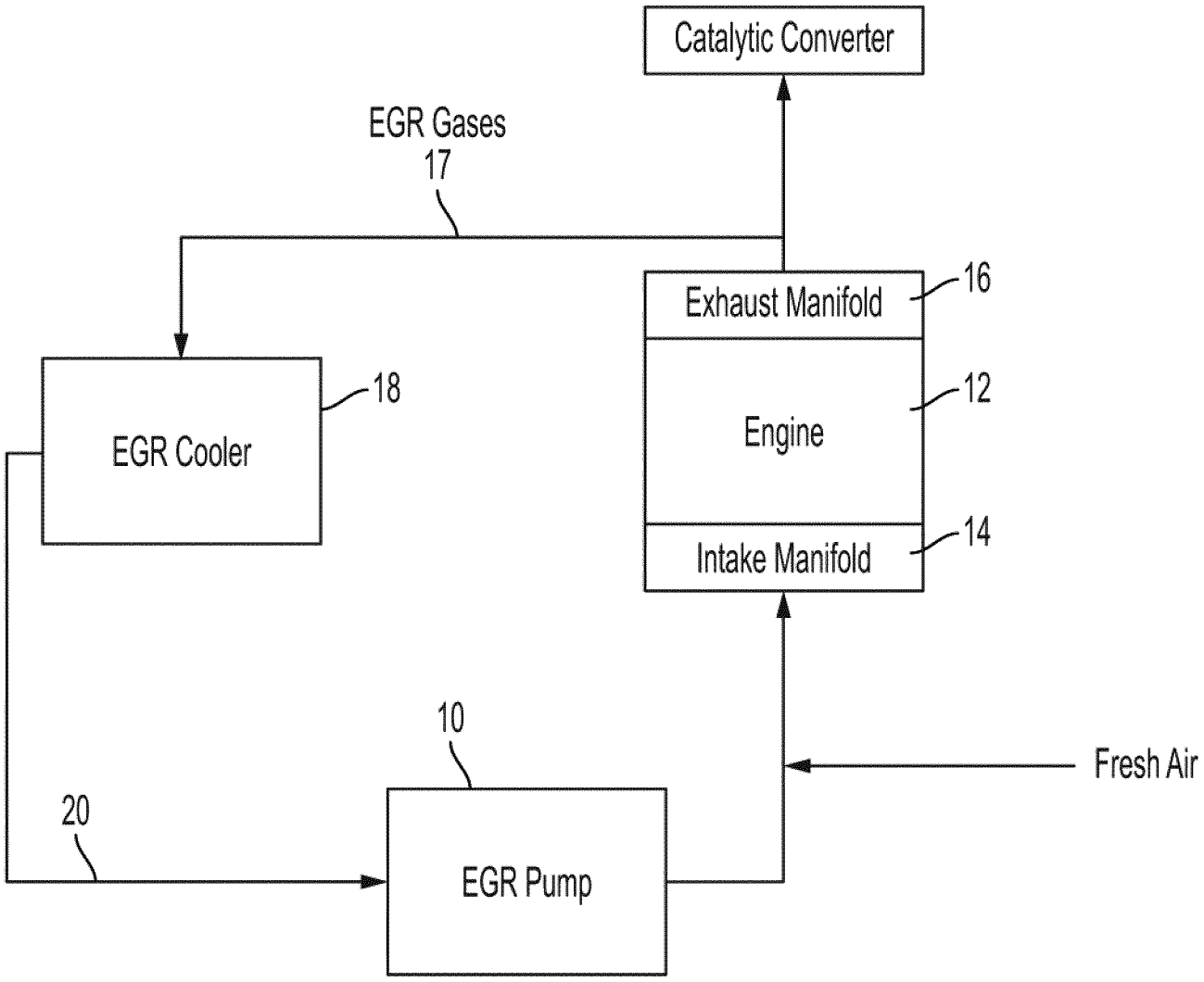
FIG. 1 is a schematic representation of an EGR system including an engine and EGR pump.

Referring to FIG. 1, there is shown a diagram of an EGR system including an EGR pump 10. The EGR system includes an engine 12 having an intake manifold 14 and an exhaust manifold 16. A portion of the exhaust gases 17 from the exhaust manifold 16 are routed to an EGR cooler 18 to adjust a temperature of the EGR stream 17. The stream 20 exiting the EGR cooler 18 is next routed to the EGR pump system 10. The gas stream is then routed to the intake manifold 14 of the engine 12 and combined with fresh air. It should be realized that a turbo charger may also be used and a portion of the exhaust gases may be used to drive the compressor of the turbo charger and the boost air from the turbo charger may be routed to the intake manifold.

Figure 2:
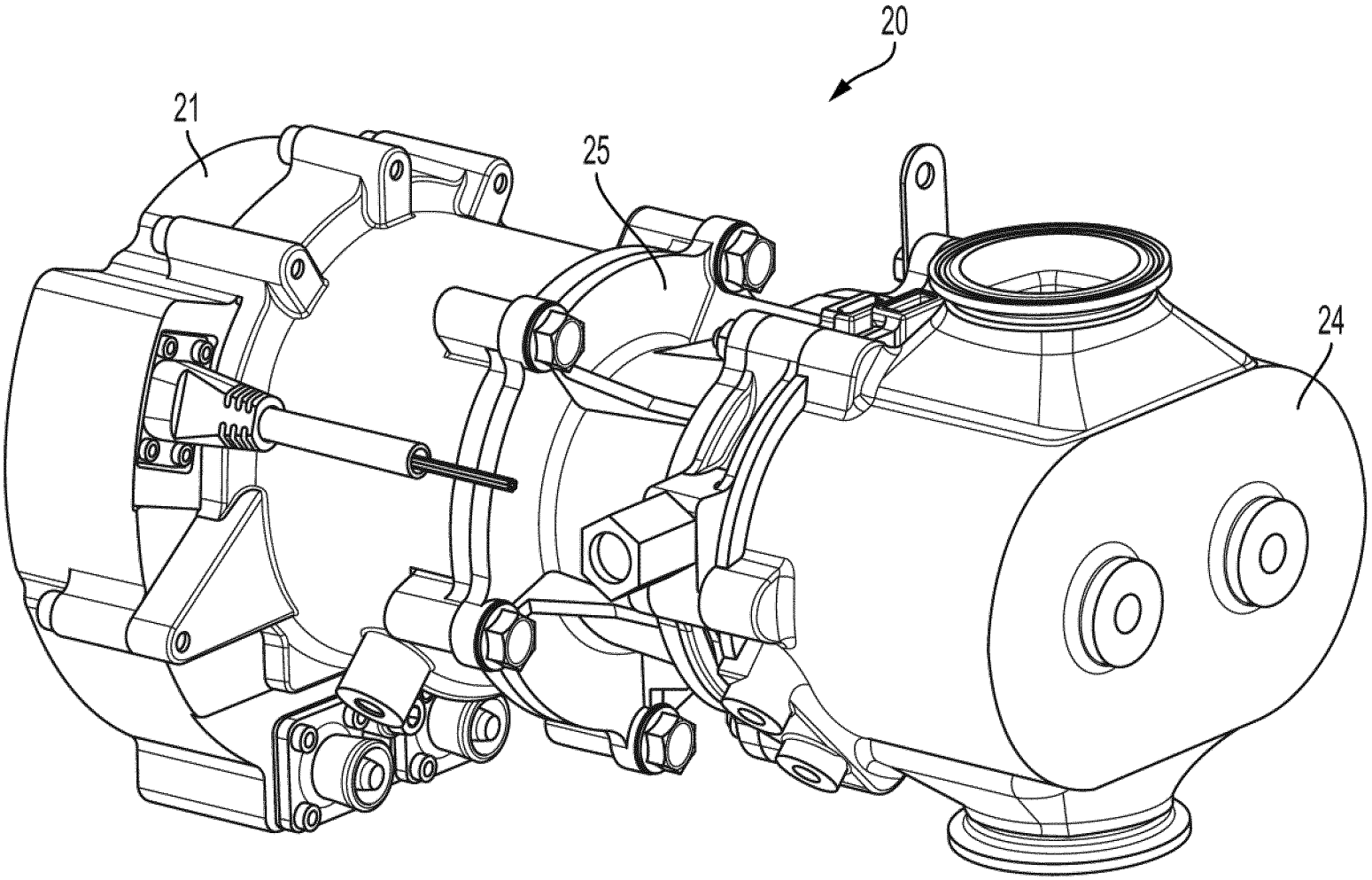
FIG. 2 is a perspective view of an EGR pump, electric motor and transmission assembly.
Figure 3:
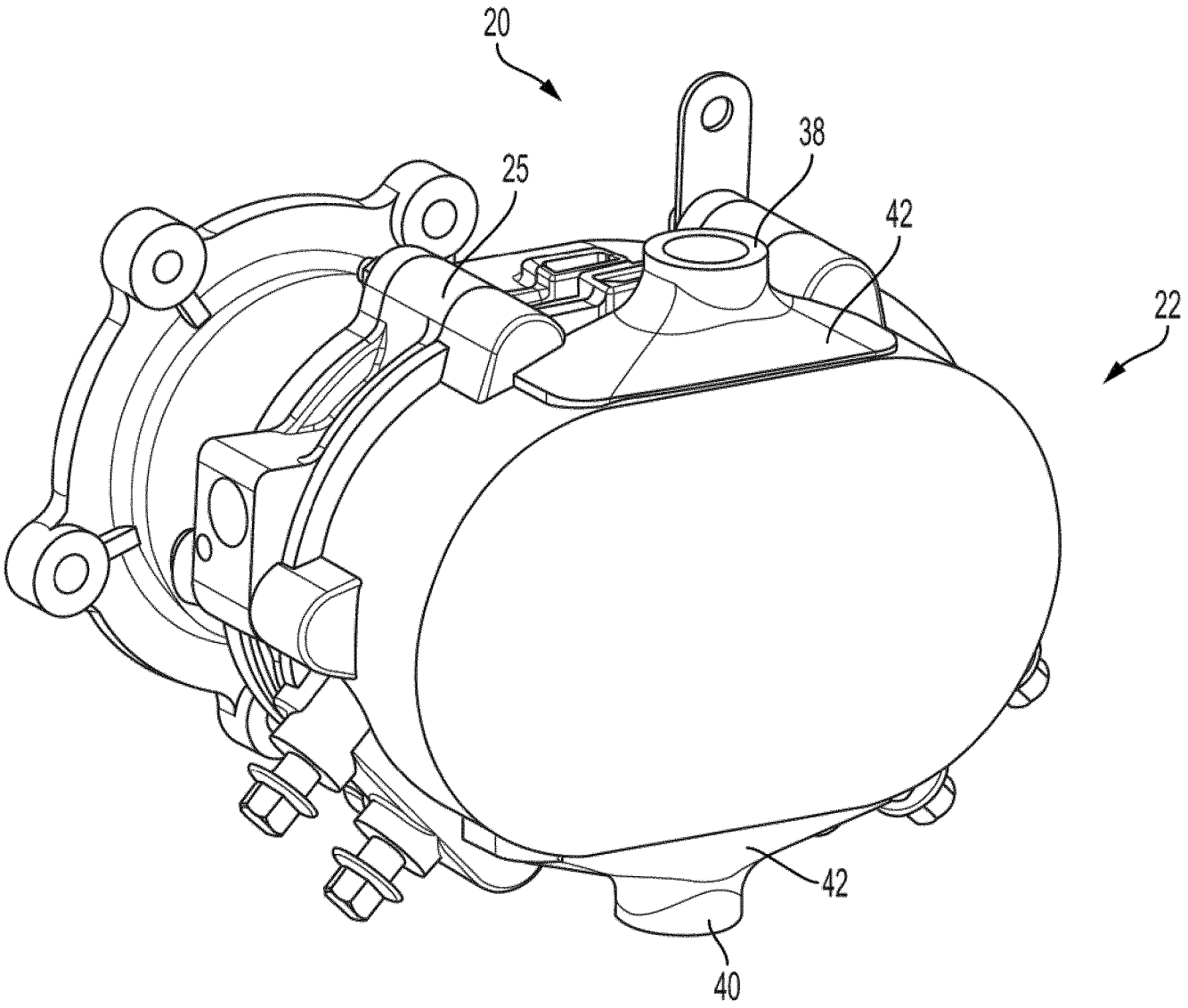
FIG. 3 is a perspective view of an EGR pump and transmission assembly.
Figure 4:
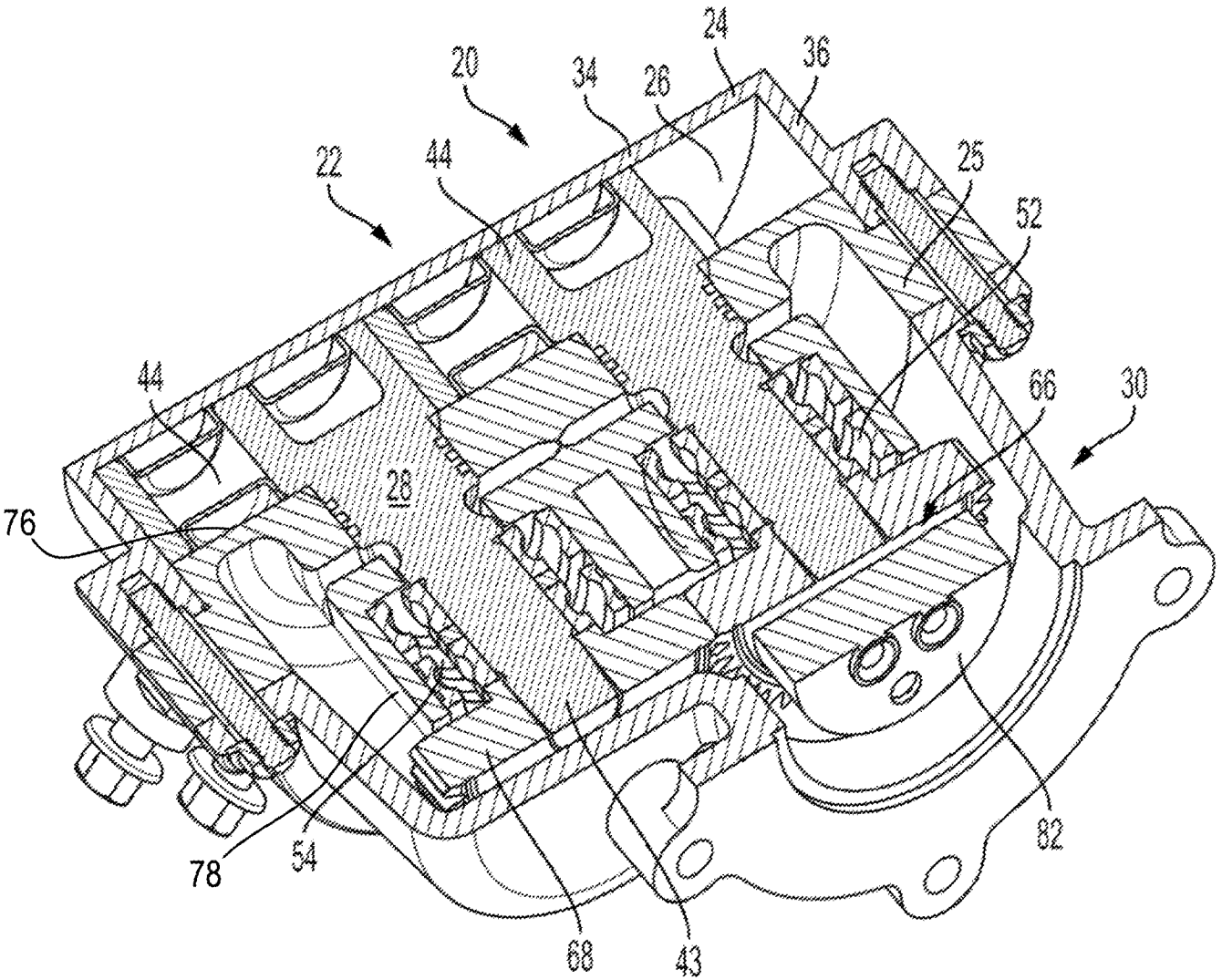
FIG. 4 is a partial sectional view of an EGR pump and transmission assembly.
Figure 5:
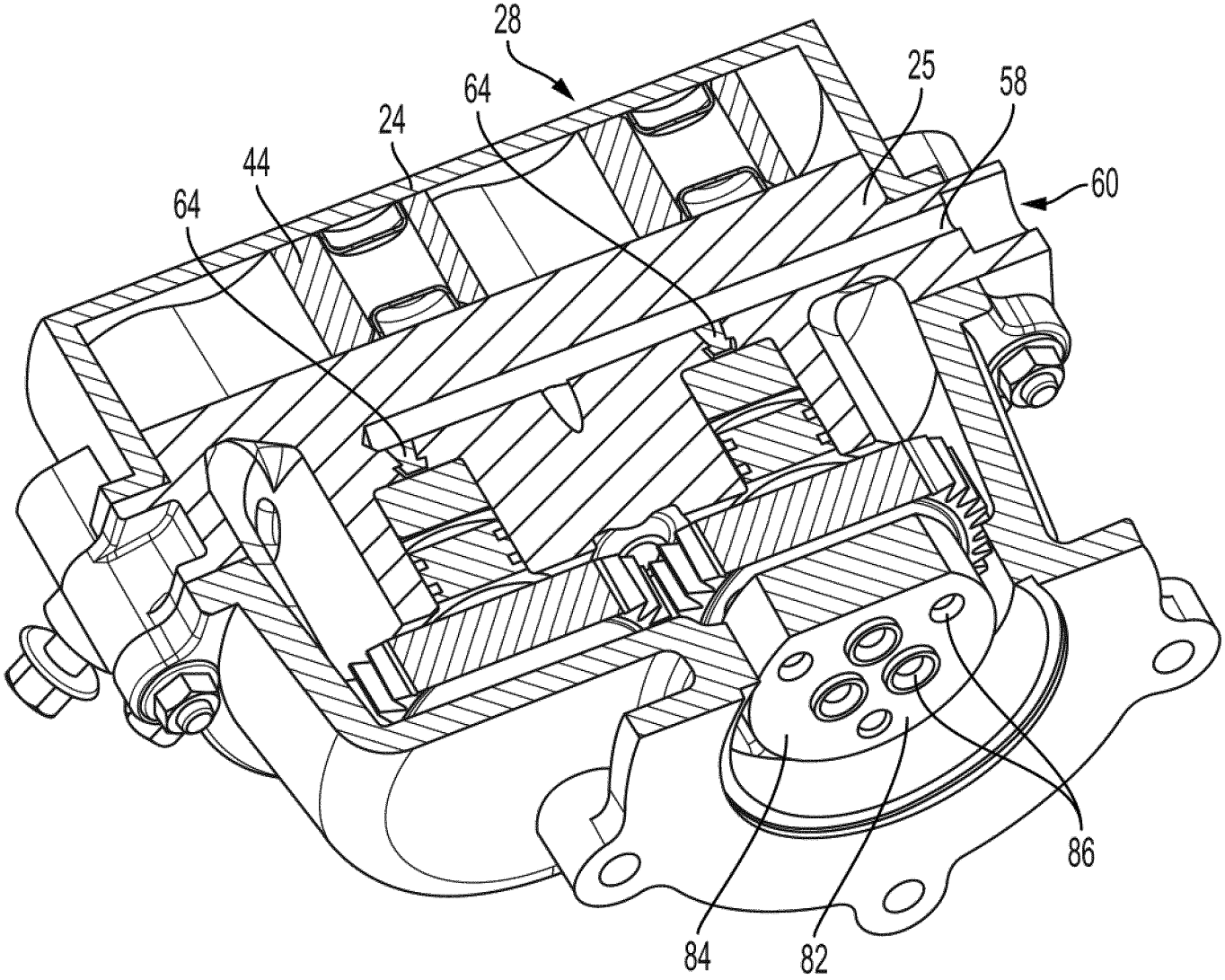
FIG. 5 is a partial sectional view of an EGR pump and transmission assembly showing an oil path.

Referring to FIGS. 2-4, there is shown an exhaust gas recirculation pump (EGR pump) system 10. The EGR pump system 10 includes an electric motor 21 having a housing. A roots device 22 is coupled to the electric motor 21. The Roots device 22 includes a housing 24 that defines an internal volume 26. Rotors 28 are disposed in the internal volume 26 and are connected to the electric motor. The rotors are supported on only a single end and are over hung or cantilevered. The electric motor 21 may be linked with the rotors 28 by a transmission assembly 30.

In one aspect, for diesel applications, the EGR pump system 10 enables higher engine efficiency by reducing engine pumping losses by enabling the use of a high-efficiency turbo with a lower exhaust backpressure in comparison to prior designs. The EGR pump system 10 provides more accurate EGR flow rate control for better combustion and emissions management. The EGR pump system 10 may provide cost benefits in comparison to a traditional EGR system by eliminating structures such as an EGR valve, variable geometry turbocharger and an intake throttle associated with such designs.

The function of the EGR pump system 10 is to deliver exhaust gas from an engine's exhaust manifold 16 to its intake manifold 14 at a rate that is variable and that is controlled. In order to pump exhaust gas, the EGR pump system 20 may use a Roots device 22 coupled to an electric motor 21 such as a 48V electric motor. The electric motor 21 provides control of EGR flow rate by managing the motor speed and in turn the pump speed and flow rate of exhaust gas.

Figure 7:
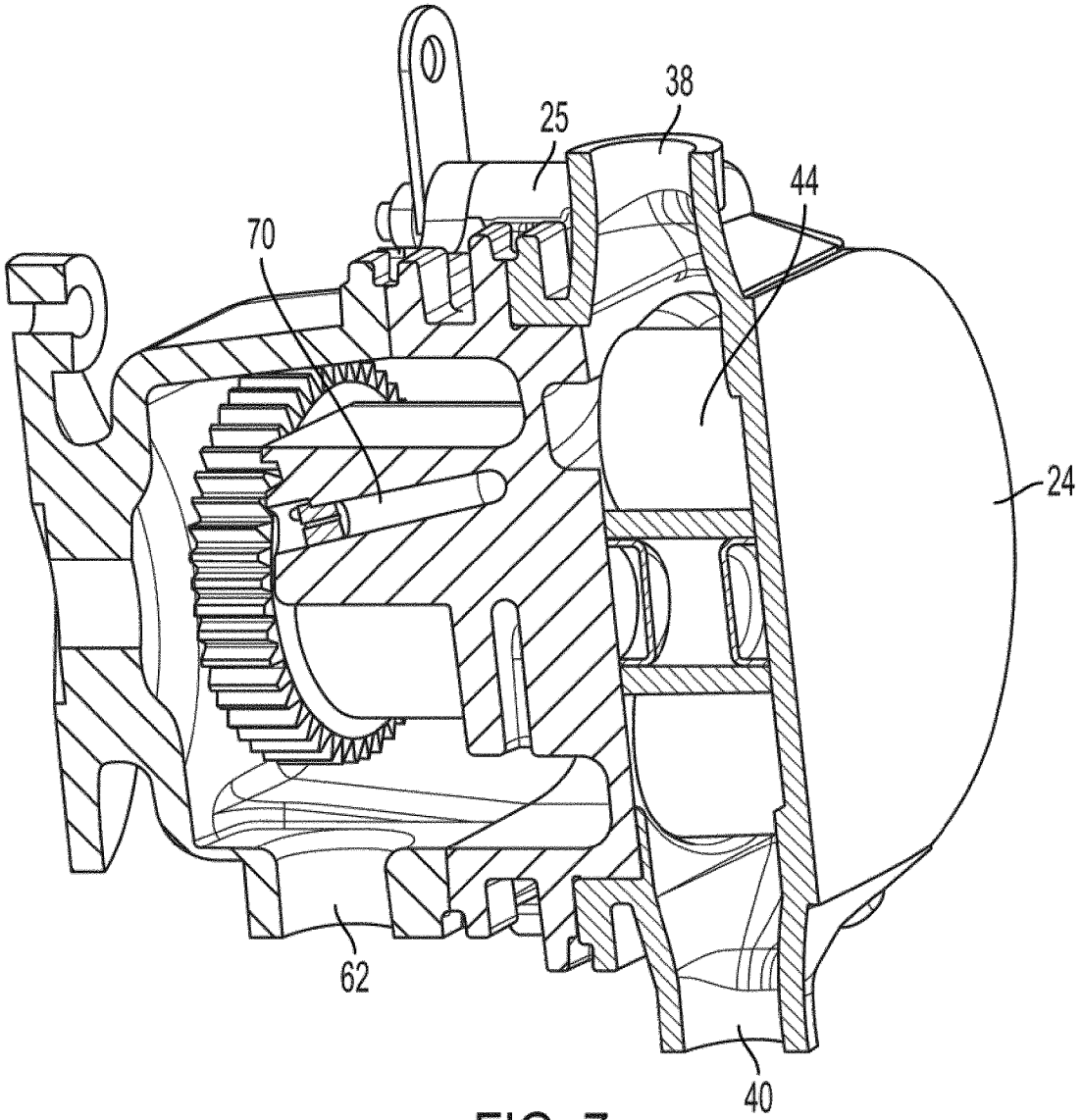
FIG. 7 is a partial sectional view of an EGR pump and transmission assembly detailing an angled inlet.
Figure 8:
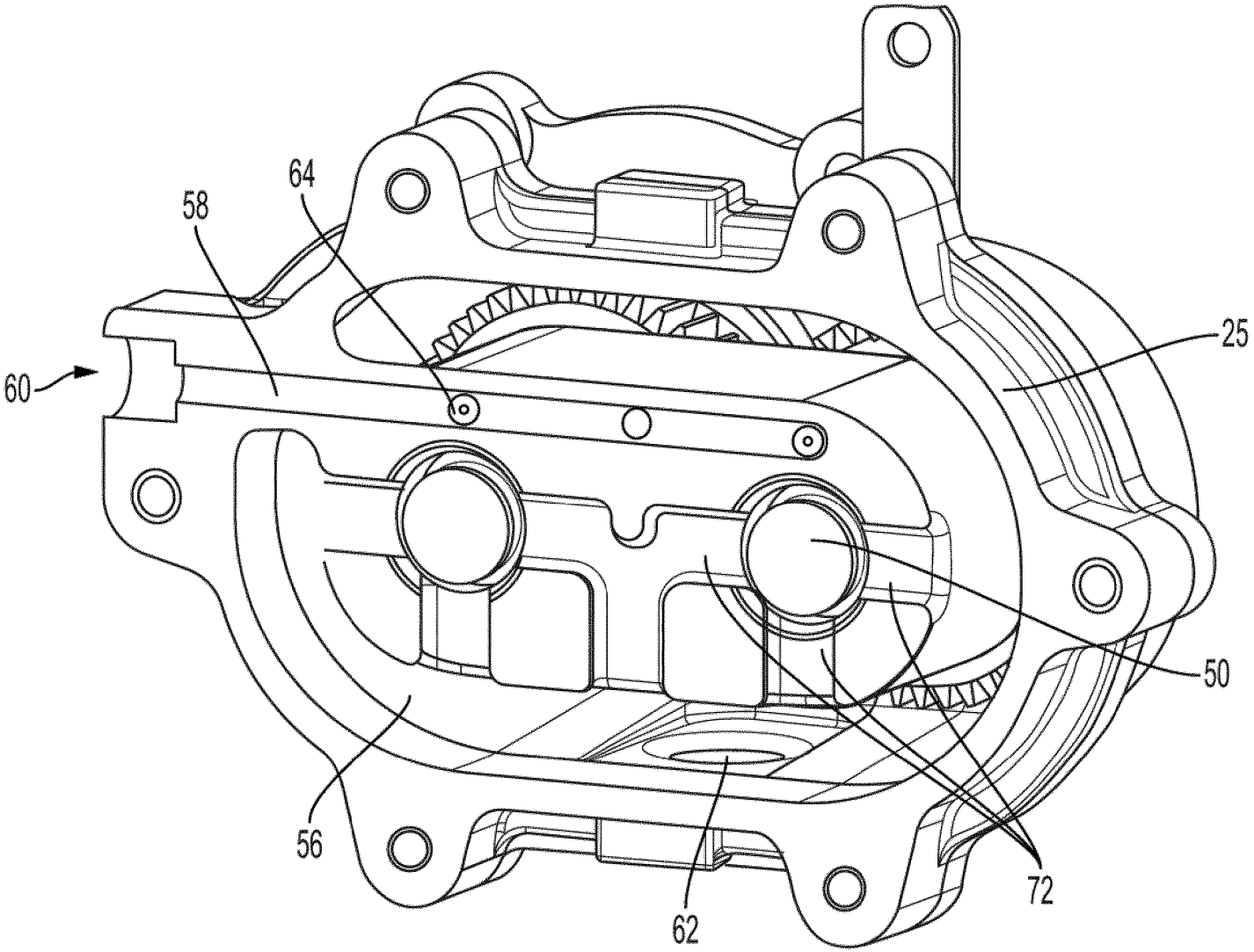
FIG. 8 is a partial perspective sectional view of an EGR pump and transmission assembly showing an oil path.
Figure 9:
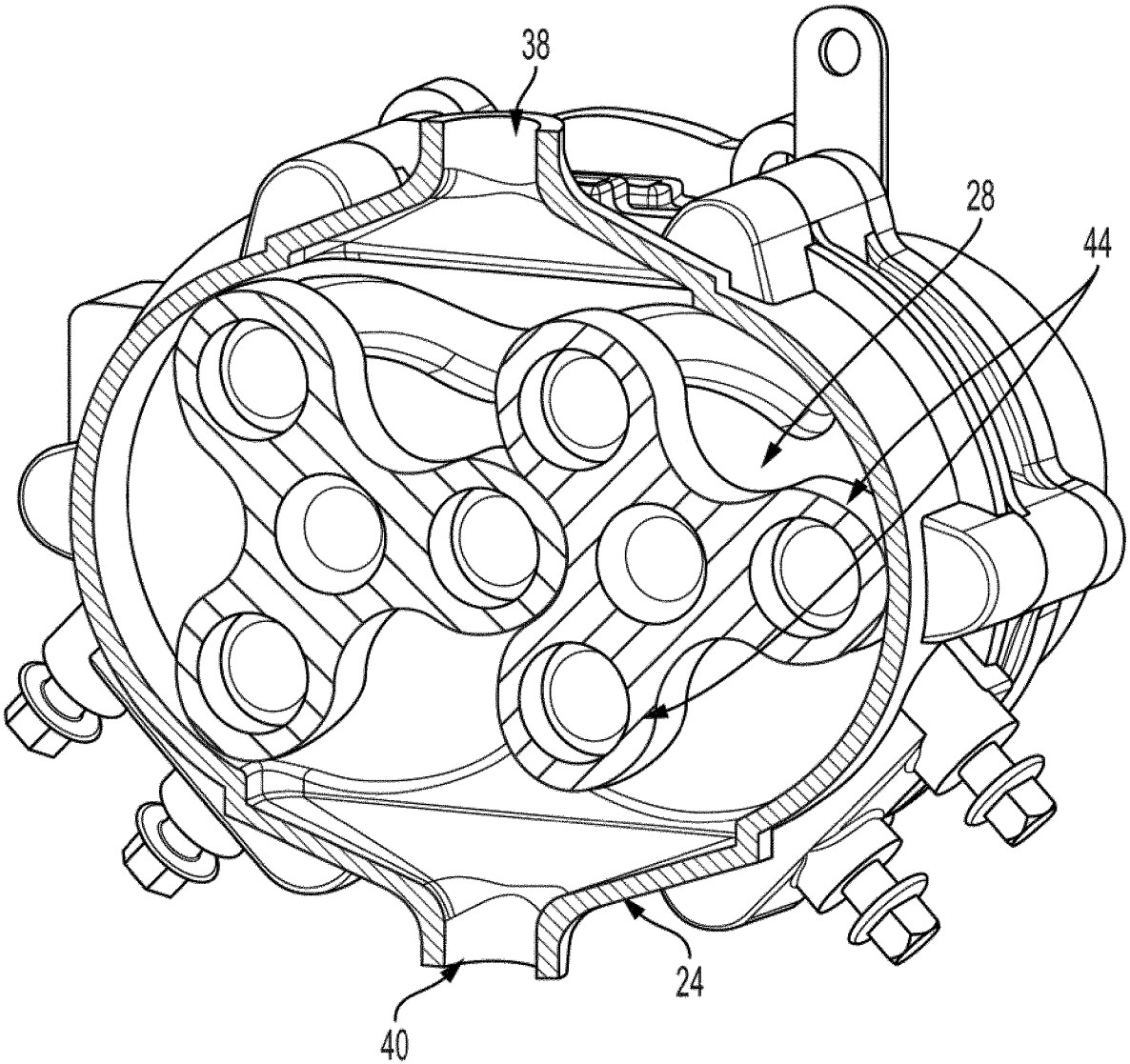
FIG. 9 is a partial perspective sectional view of an EGR pump detailing rotor profiles and a back flow port.
Figure 10:
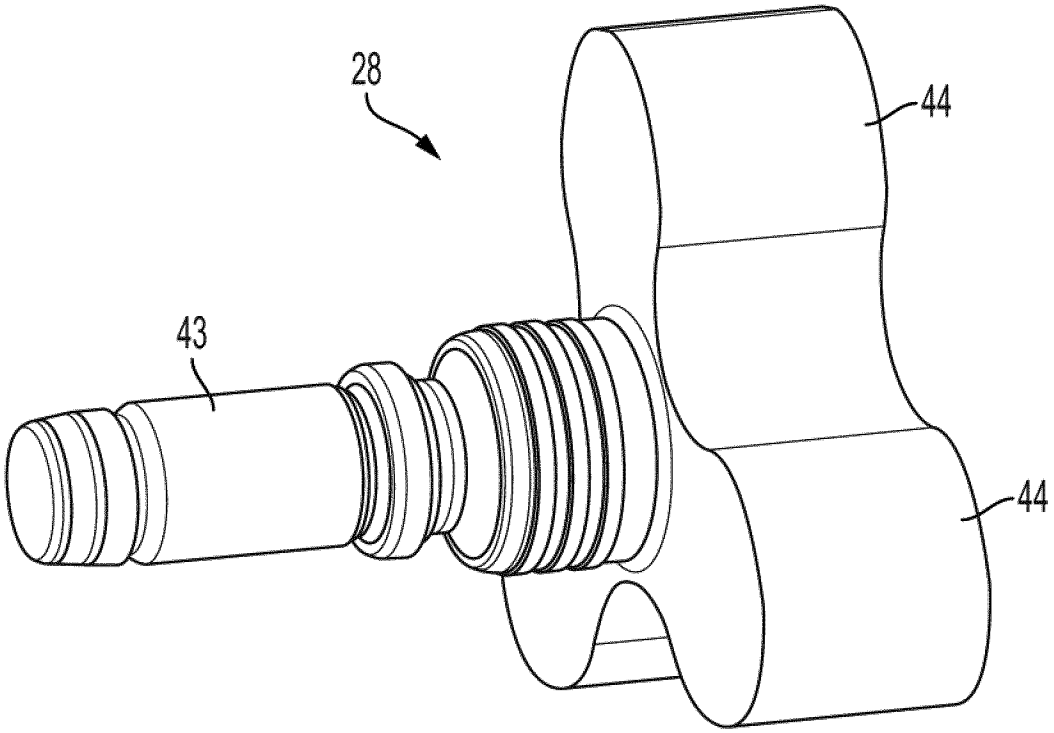
FIG. 10 is a perspective view of a rotor.
Figure 11:
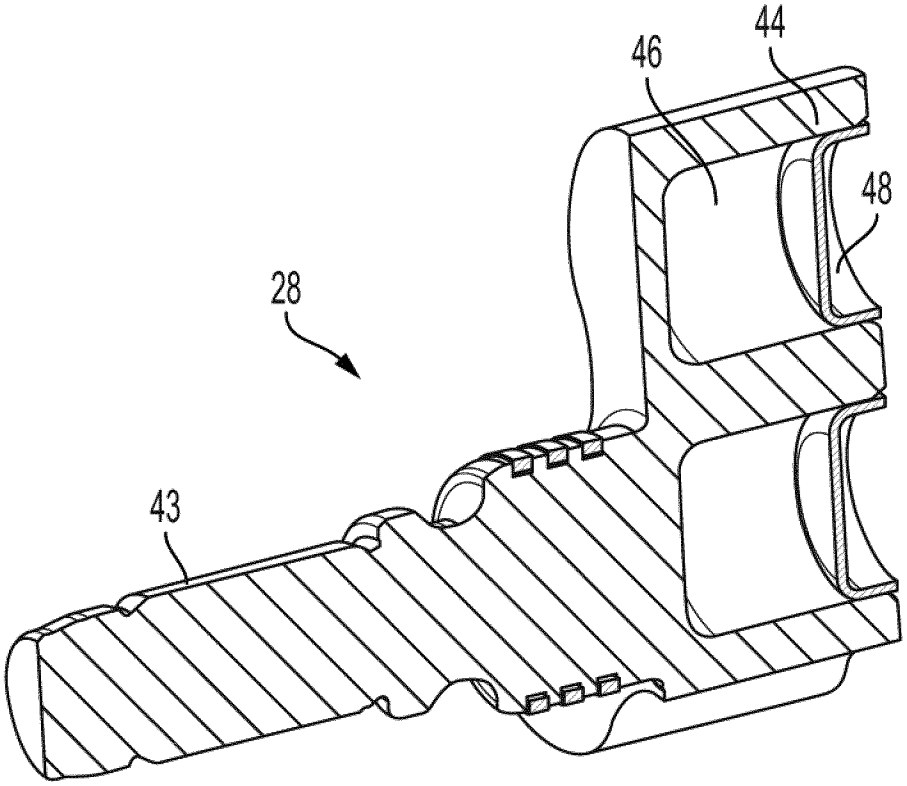
FIG. 11 is a partial sectional view of a rotor.
Figure 12:
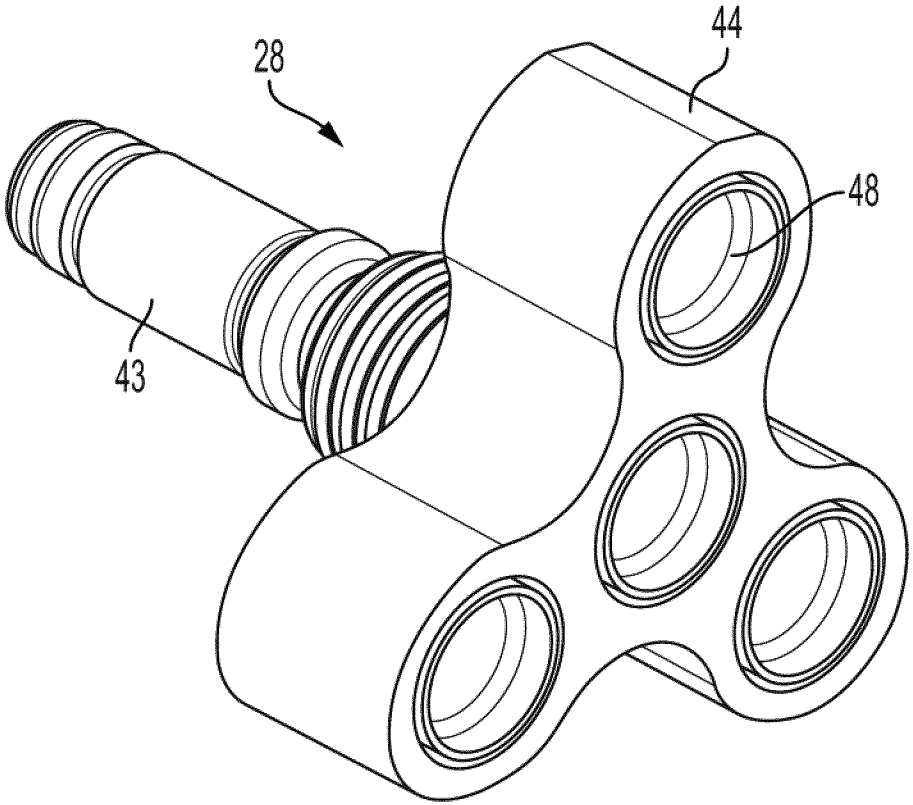
FIG. 12 is a perspective view of a rotor.

Referring to FIGS. 3-4, the exhaust gas recirculation pump system 10 includes a housing 24 that defines an internal volume 26 that receives the rotors 28. The housing 24 includes a generally elliptical shape that accommodates the lobes 44 of the rotors 28. The housing 24 includes a housing end face 34 linked with a housing side wall 36. The portion of the housing 24 opposite the end face 34 is open. The housing 24 includes radial inlet and outlet ports 38, 40 formed therein. The inlet port 38 and the outlet port 40 include an angled geometry 42 best shown in FIGS. 3 and 7. In the depicted embodiments, the angled geometry 42 is in the shape of a parallelogram. The parallelogram shape provides a gradual or regulated release of the carrier volume of exhaust gas to the outlet port 40. This results in reduced pulsations and potential noise, vibration and harshness (NVH).

Referring to FIGS. 9-12, the exhaust gas recirculation pump system 20 includes rotors 28 disposed within the housing 24. The rotors 28 include a rotor shaft 43 having a plurality of lobes 44 formed thereon, the lobes 44 include a straight profile having a modified cycloidal geometry as disclosed in PCT application PCT/US16/47225 filed on Aug. 16, 2016, which is herein incorporated by reference. The modified cycloidal geometry includes a cycloid curve modified with at least two interpolated and stitched spline curves. The rotor lobe 44 profile further includes a flattened tip. The rotors 28 may be formed by a metal injection molding process. The rotors 28 include a rotor shaft 43 that extends to the lobe body 44 of the rotors. The rotor shaft 43 terminates at the lobe body 44 as the rotors 28 are supported on only a single end as described above. The lobe body 44 includes hollow cavities 46 formed therein corresponding to the inner portion of the three lobes 44 as well as along a direction of the rotor shaft 43. The hollow cavities 46 are sealed by caps 48. The hollow rotor lobe structure provides weight savings and improvements to the efficiency of the EGR pump.

Figure 13:
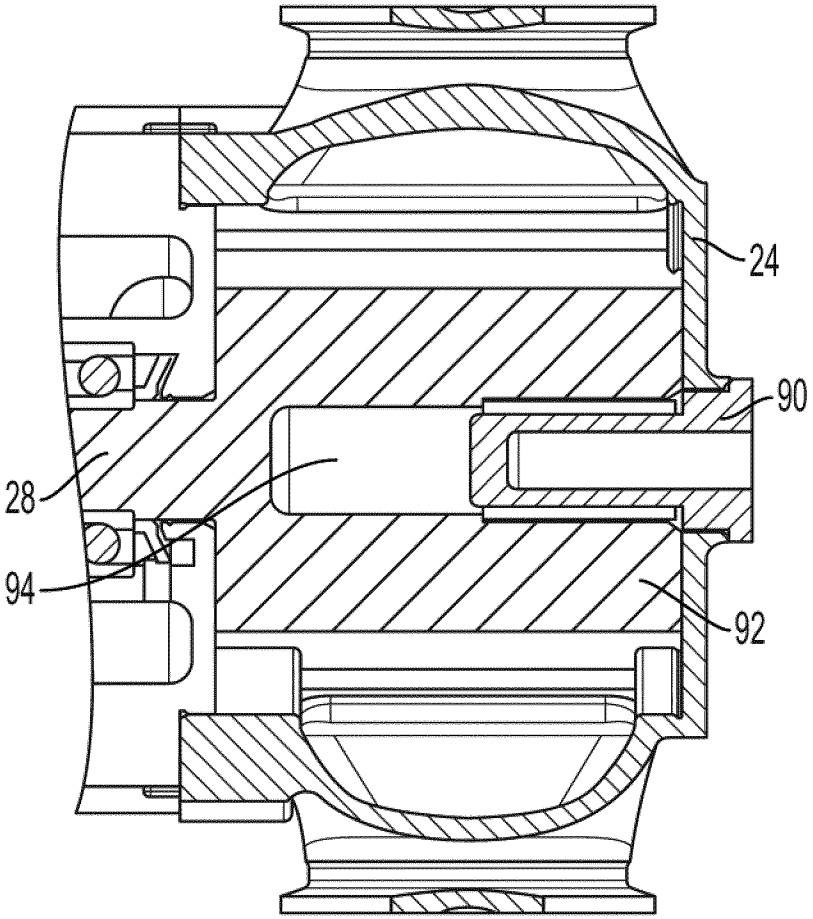
FIG. 13 is a partial sectional view of a rotor housing including a bushing.

Referring to FIG. 13, the housing 24 may include a bushing 90 attached or formed thereon. The bushing 90 may be formed of metal such as bronze, or another material such as a polymer or composite material. The bushing 90 may support the inner diameter 92 of a hole 94 bored into the rotor 28 to limit deflection of the rotors 28 in an overhung or cantilevered configuration. The bushing 90 may be easily replaceable and serviceable.

In an overhung configuration, there is concern that under a high pressure ratio condition, the rotors 28 could deflect and contact the housing 24. The bushing 90 limits rotor deflection, while providing an interface for the rotor 28 to contact and still spin without galling, or causing other failure modes. In one aspect, the bushing 90 is positioned inside the rotor 28 with clearance. In this manner the bushing 90 only makes contact with the rotor 28 when a deflection occurs and acts as a protection against contact with the housing 24. The bushing 90 may be installed over a stub shaft that is part of the housing 24 or a removable rear cover.

Referring to FIGS. 4-8, the transmission housing 25 includes journals 50 formed therein receiving bearings 52 that support the rotors 28. The bearings 52 support the rotors 28 on only one end, such that the rotors 28 are overhung or cantilevered. In the depicted figures, two bearings 52 are positioned about the rotor shaft 42. A spacer assembly 54 is provided in the bearings 52 to direct a load from an inner race of the bearing to an outer race. The bearings 52 in an EGR pump 10 require continuous oil flow for lubrication and heat dissipation. Oil flow can cause churning losses leading to pump inefficiency. By maintaining proper oil flow and improved oil drainage, the churning losses can be reduced, increasing pump efficiency.

Figure 14:
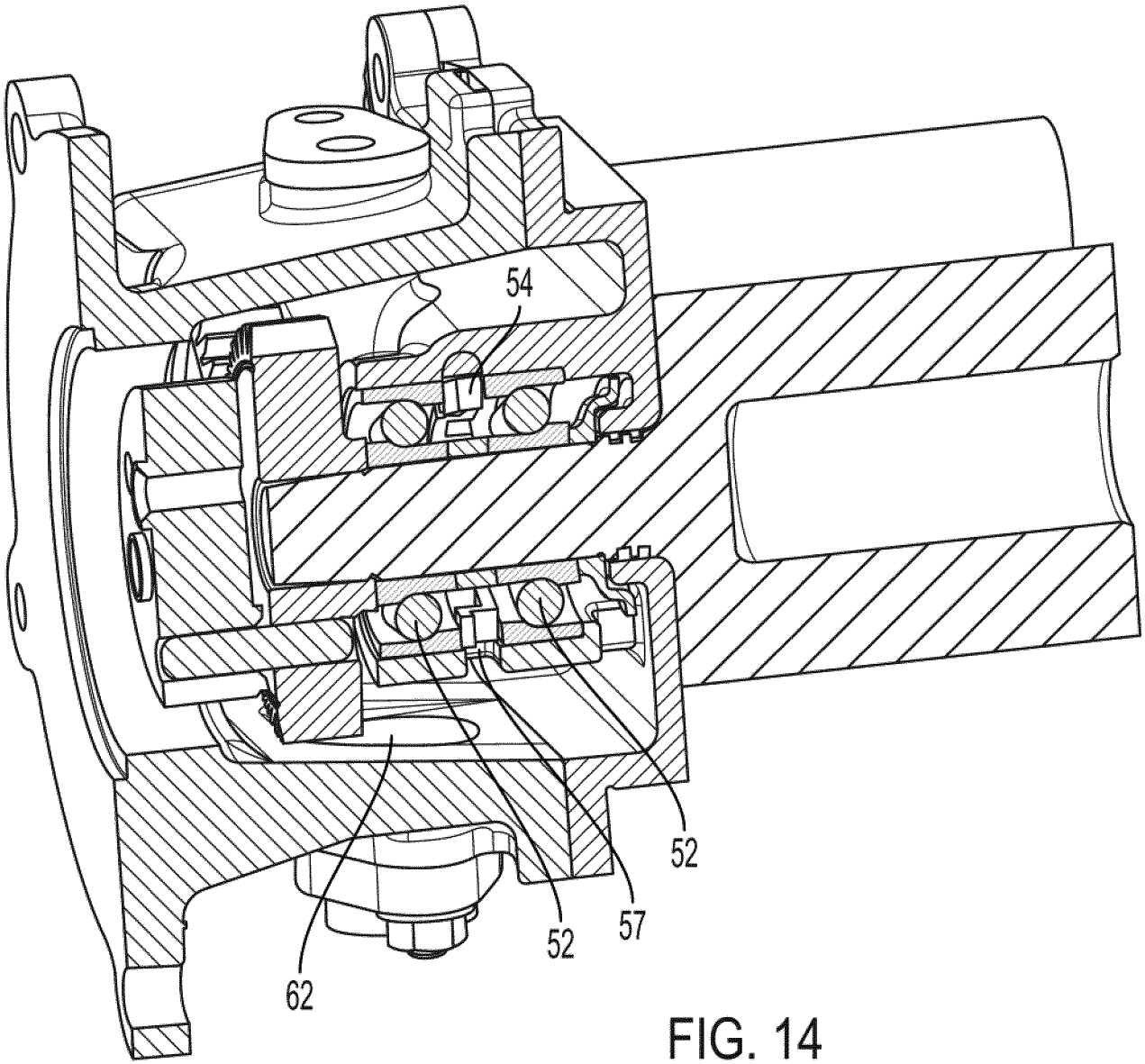
FIG. 14 is a partial perspective sectional view of an EGR pump and transmission assembly showing bearings and a spacer assembly.
Figure 15:
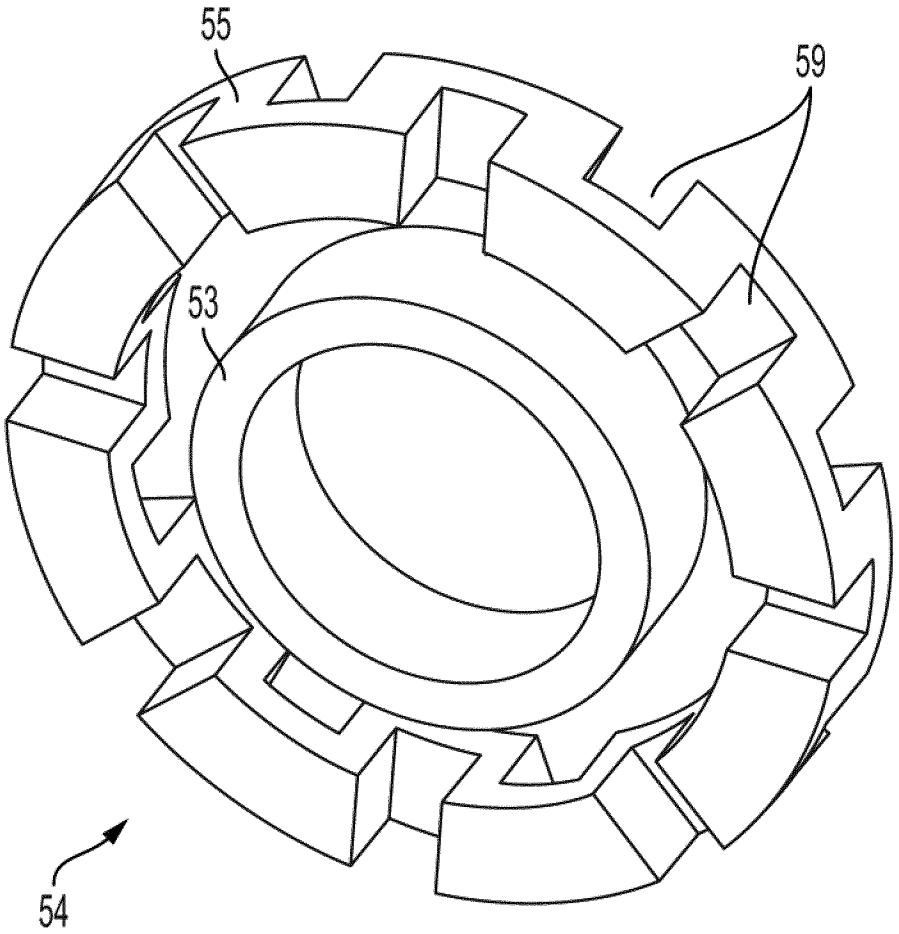
FIG. 15 is a perspective view of a spacer assembly.

The bearing arrangement 52 best shown in FIG. 14-15 requires two bearings 52 with the spacer assembly 54. The spacer assembly 54 includes an inner spacer 53 and an outer spacer 55 which are positioned in one bearing bore 57. The bearings 52 are lubricated with oil that enters from an inlet port 61 formed in the transmission housing 25 and is directed to the spacers 53, 55. The spacers 53, 55 provide bearing pre-load for proper operation. The bearing 52 and spacer assembly 54 arrangement allows continuously flowing oil into and out of the bearing bore 57 which has the spacer assembly 54. The outer bearing spacer 55 includes notches 59, allowing two-way oil flow. The center cavity drain 62 allows oil out of the bearing bore 57 without forced oil flowing though the bearings 52.

Referring to FIGS. 3-6, the transmission housing 25 includes an oil cavity 56 formed therein. The oil cavity 56 is linked with an oil path 58 formed in the transmission housing 25. The oil path 58 includes oil inlets 60 extending to oil outlets 62. The oil inlets 60 and outlets 62 are coupled to an engine oil circulation system such that the oil path lubricates bearings 52 and a transmission assembly 30.

The oil path 58 includes selected orifices 64 disposed therein providing a selectable amount of oil to the bearings 52 and transmission assembly 30. In the depicted embodiment, selectable orifices 64 are positioned at each of the bearings 52, at the oil inlet 60 and at a selected location of the transmission assembly 30.

Figure 16:
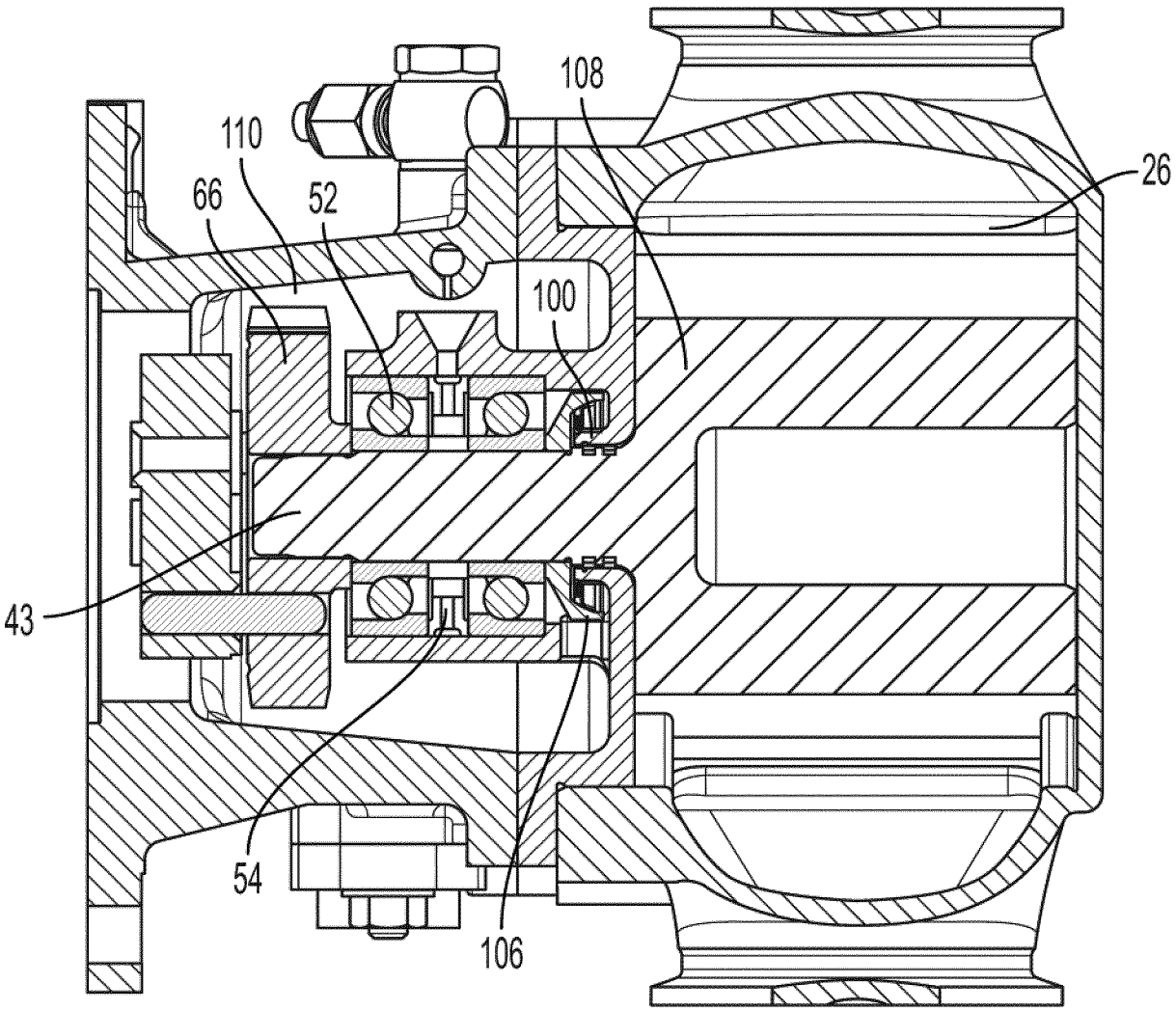
FIG. 16 is a partial sectional view of an EGR pump and transmission assembly showing an oil path to a spacer assembly and a lip seal.
Figure 17:
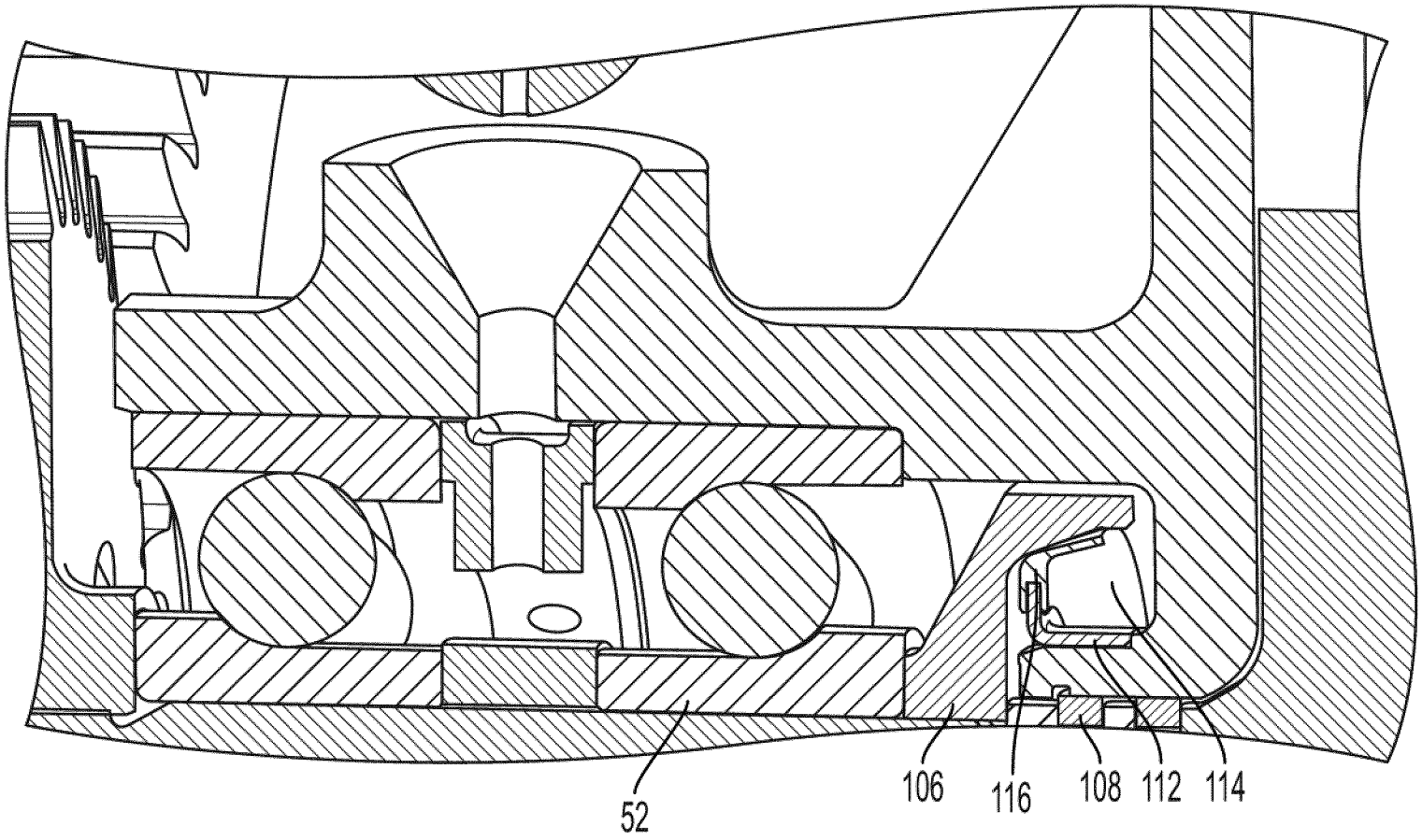
FIG. 17 is a partial sectional view of an EGR pump and transmission assembly showing a lip seal in a normal unsealed state.
Figure 18:
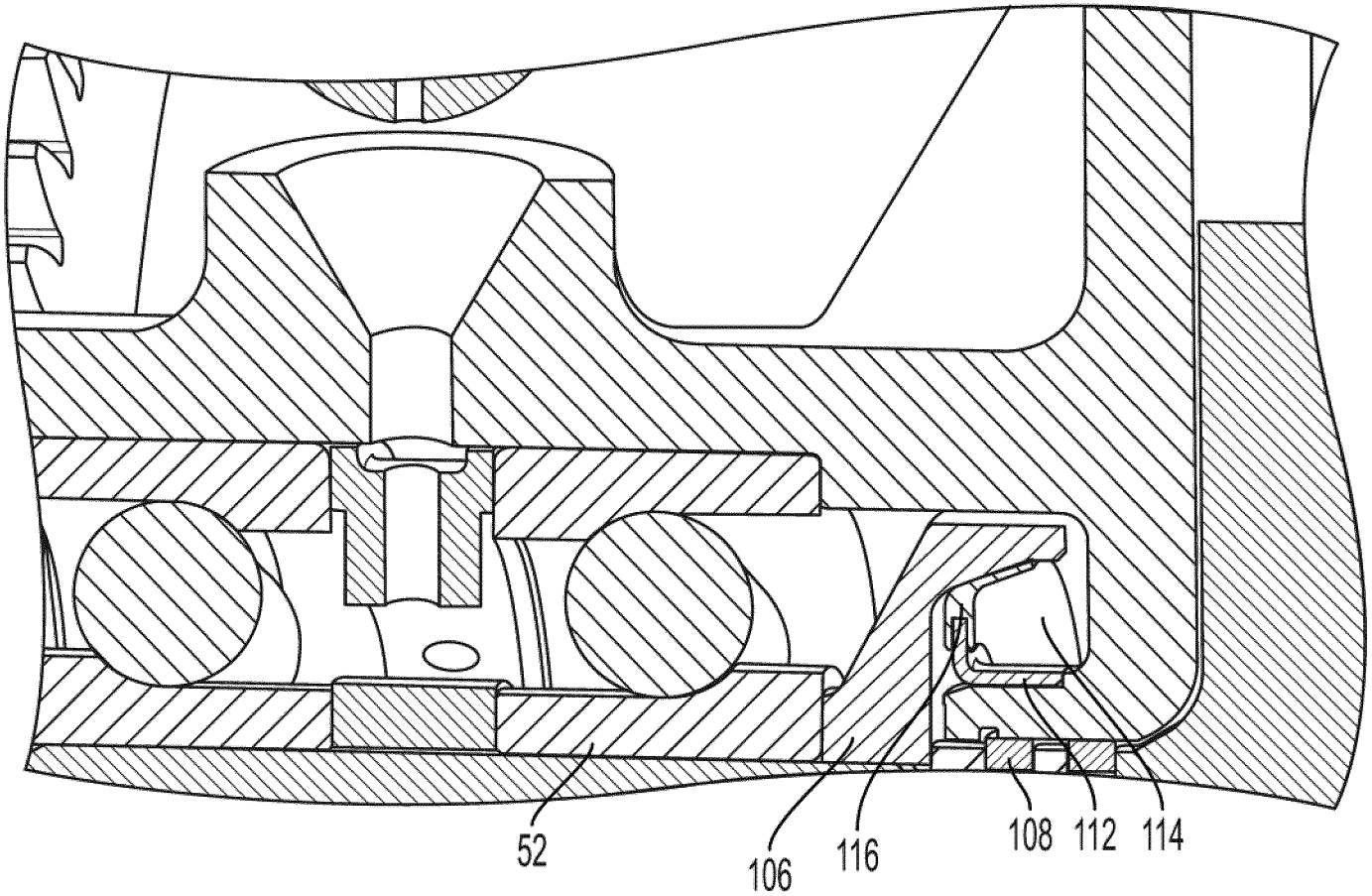
FIG. 18 is a partial sectional view of an EGR pump and transmission assembly showing a lip seal in a sealed state.

Referring to FIGS. 16-18, a lip seal 100 may be utilized to prevent the flow of oil vapor into the EGR pump rotor cavity 26 and is designed in such a way that the lip 116 is not contacting either an oil slinger 106 or rotor shaft 43 during normal operation (when exhaust cavity pressure is higher than oil sump pressure) to eliminate seal drag. During periodic events, such engine intake throttle closures, the EGR pump rotor cavity pressure will decrease causing the seal lip 116 to make contact and prevent backflow of oil vapors.

The EGR pump has forced oil lubrication of its bearings 52 and gears 66 and this oil should not enter the EGR loop of the engine. Sealing rings 108 are used to separate the high pressure exhaust in the rotor cavity 26 of the pump from the bearing/gear cavity 110, but these rings 108 do not create a perfect seal. The exhaust pressures seen in the rotor cavity 26 are typically very high (up to 500 kPa absolute), and a certain amount of exhaust is allowed to leak past these sealing rings 108 into the bearing/gear cavity 110 (this is known as blowby). However, during some engine operating conditions that are much less frequent, the pressure in the rotor cavity 26 might decrease substantially enough to drive flow across the rings 108 in the opposite direction (i.e. closing engine intake throttle). Once in the rotor cavity 26, the oil can mix with the EGR soot, causing fouling of the pump, intake manifold, and excess hydrocarbon emissions from the engine combustion.

The flexible lip seal 100 includes a base or substrate 112 formed of metal or another hard material that includes a flexible body 114 attached thereon. The body 114 may be formed of a rubber or polymer material with flexible properties such that the body 114 including a lip portion 116 is normally not contacting the rotating surface of the rotor shaft 43 or oil slinger 106. By its shape and flexible properties, the lip portion 116 can be pushed away from these rotating surfaces by flow across the sealing rings 108 from the rotor cavity 26 towards the bearings 52, as shown in FIG. 17. During this operation, the seal lip 116 does not make contact or seal, but also does not introduce drag or accumulate wear.

Then when an event occurs that results in lower rotor cavity pressure relative to the normal operating condition, such as closing the intake throttle, the change in the pressure differential is sufficient to flex the lip 116 of the seal 100 to touch the rotating shaft 43 or oil slinger 106 surfaces, thus creating a contact lip seal 100 that won't allow any oil or oil vapor past, as shown in FIG. 18. During this operation the seal will be well lubricated, and because this is not the normal operating condition for the engine the accumulated wear over time will be substantially less than if a conventional seal were used that is making contact or dragging all of the time. This arrangement allows the lip seal 100 to last on applications such as heavy duty diesel engines which require very long component life.

Referring to FIGS. 2-5, the exhaust gas recirculation pump system 20 includes a transmission assembly 30 that includes a drive gear 66 that is meshed with a driven gear 68. The drive gear 66 is coupled to a drive shaft of the electric motor and to the rotor shaft 43. The driven gear 68 is meshed with the drive gear 66 and is coupled to the other rotor shaft 43. The transmission housing 25 includes angled transmission oil inlet 70 formed therein directing oil to the meshing of the drive gear 66 and the driven gear 68.

Figure 6:
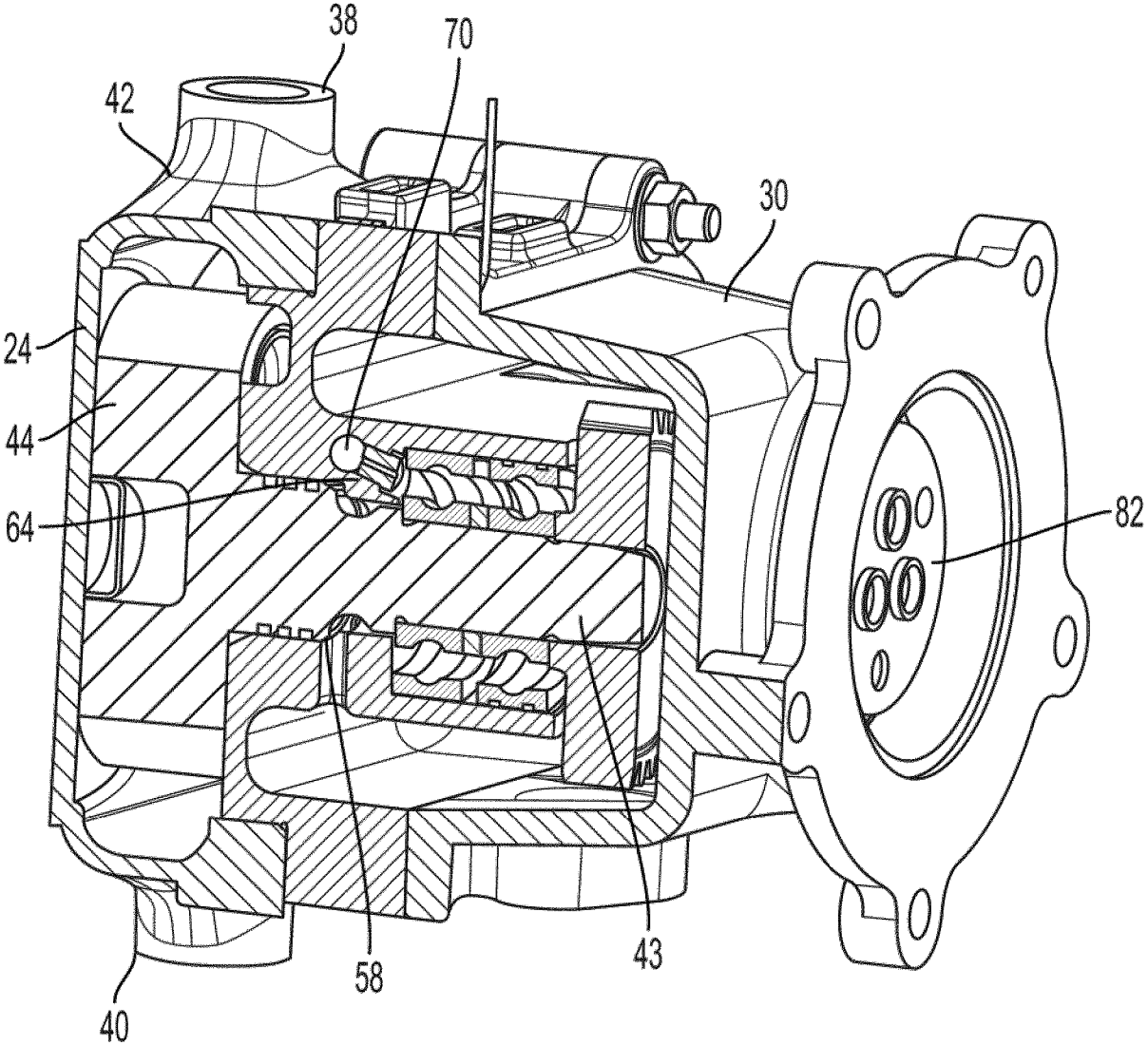
FIG. 6 is a partial sectional view of an EGR pump and transmission assembly showing an oil path.

Referring to FIG. 6, the transmission housing 25 includes journals 50 formed therein receiving bearings 52 that support the rotors 28. The journals 50 formed on the transmission housing 25 include a plurality of bearing oil outlets 72 formed therein, with three shown in the depicted embodiment. The bearing oil outlets 72 allow oil to exit the bearings 52 to be routed to the oil outlet 62 formed in the transmission housing 25.

Referring to FIGS. 1-6, the exhaust gas recirculation pump system 20 includes transmission housing or bearing plate attached to the transmission housing 25. The bearing plate includes bearing plate inner and outer surfaces 76, 78. The bearing plate inner surface 76 faces a rotor end face. The bearing plate outer surface 78 includes the journals 50 formed therein receiving bearings 52 as described above. The bearing plate outer surface 78 includes the oil cavity 56 formed therein.

Referring to FIGS. 2-4, the exhaust gas recirculation pump system 20 includes an insulated coupling 82 joining a rotor shaft 42 to an electric motor shaft. The insulated coupling 82 reduces heat transfer from the housing 24 to the electric motor. In one aspect, the insulated coupling 82 is formed of PEEK or may be formed of other materials such as plastic composites or ceramic insulating type materials.

In one aspect, the insulated coupling 82 includes a disk shaped body 84 having a plurality of through holes 86. Pins formed on the electric motor shaft are received in a portion of the through holes 86 and pins formed on the drive gear 66 of the transmission assembly 30 are received in another portion of the through holes 86. The insulated coupling 82 connects the electric motor to the rotors 28 and reduces heat transfer.

Alternatively, the insulated coupling 82 may include a pentagonal body having an inner bore formed therein. The pentagonal body may include a flange formed on one end. The inner bore may be sized to receive an end of the rotor shaft which has a complementary shape and size. The outer shape of the pentagonal body may be received in a corresponding drive bore formed on the drive shaft of the electric motor. In this manner, the drive shaft is thermally isolated and coupled to the rotor shaft.

We claim:

1. An exhaust gas recirculation EGR pump system for an internal combustion engine comprising:

an EGR gas source;

an electric motor assembly;

a roots device coupled to the electric motor assembly, the roots device including a housing defining an internal volume, wherein the housing includes a radial inlet port receiving the EGR gas source and an outlet port expelling the EGR gas source from the housing;

rotors disposed in the internal volume and connected to the electric motor assembly; and a transmission housing attached to the housing, the transmission housing including journals formed therein receiving bearings that support the rotors on only a single end of the rotors such that the rotors are overhung without bearing support at an opposite end of the rotors, at least when the rotors are in an undeflected condition.

2. The exhaust gas recirculation pump system of claim 1 wherein the inlet port and the outlet port include an angled geometry.

3. The exhaust gas recirculation pump system of claim 1, wherein the transmission housing includes an oil path formed therein, the oil path including oil inlets extending to oil outlets, said oil inlets and oil outlets coupled to an engine oil circulation system, wherein the oil path lubricates the bearings and a transmission assembly.

4. The exhaust gas recirculation pump system of claim 3 further including selected orifices disposed in the oil path providing a selectable amount of oil to the bearings.

5. The exhaust gas recirculation pump system of claim 1, wherein the journals formed in the transmission housing include a plurality of bearing oil outlets formed therein.

6. The exhaust gas recirculation pump system of claim 1, wherein the transmission housing includes an angled transmission oil inlet formed therein.

7. The exhaust gas recirculation pump system of claim 1 wherein the transmission housing includes a lip seal disposed therein, the lip seal movable in response to a pressure differential to contact an oil slinger or rotor sealing a rotor cavity from a bearing cavity.

8. The exhaust gas recirculation pump system of claim 7 wherein the lip seal includes a base having a flexible body disposed thereon, the flexible body including a lip portion formed thereon wherein the lip portion does not seal in a normal operating condition.

9. The exhaust gas recirculation pump system of claim 7, wherein the lip seal includes a base having a flexible body disposed thereon, the flexible body including a lip portion formed thereon, wherein the lip portion seals on the oil slinger or rotor sealing the rotor cavity from the bearing cavity in response to a lower rotor cavity pressure.

10. The exhaust gas recirculation pump system of claim 1 wherein the bearings include a spacer assembly positioned in a bearing bore between the bearings, the spacer assembly including an inner spacer spaced radially from an outer spacer.

11. The exhaust gas recirculation pump system of claim 10 wherein the outer spacer includes notches formed therein allowing two way oil flow into and out of the bearings.

12. The exhaust gas recirculation pump system of claim 1 including an insulated coupling joining a rotor shaft to an electric motor shaft.

13. The exhaust gas recirculation pump system of claim 12 wherein the insulated coupling is formed of PEEK.

14. The exhaust gas recirculation pump system of claim 12, wherein the insulated coupling includes a disk shaped body having a plurality of through holes, wherein pins formed on the electric motor shaft are received in a portion of the through holes and pins formed on a drive gear are received in another portion of the through holes.

15. The exhaust gas recirculation pump system of claim 1, wherein the housing includes a bushing attached thereon, the bushing positioned to support an inner diameter of a hole bored in one of the rotors only during a deflection of the rotor.

16. An exhaust gas recirculation EGR pump system for an internal combustion engine comprising:

an EGR gas source;

an electric motor assembly;

a roots device coupled to the electric motor assembly, the roots device including a housing defining an internal volume, wherein the housing includes a radial inlet port receiving the EGR gas source and an outlet port expelling the EGR gas source from the housing;

rotors disposed in the internal volume and connected to the electric motor assembly; and a transmission housing attached to the housing, the transmission housing including a lip seal disposed therein, the lip seal movable in response to a pressure differential to contact an oil slinger or rotor sealing a rotor cavity from a bearing cavity;

wherein the lip seal includes a base having a flexible body disposed thereon, the flexible body including a lip portion formed thereon, wherein the lip portion does not seal in a normal operating condition.

17. The exhaust gas recirculation pump system of claim 16, wherein the lip portion seals on the oil slinger or rotor sealing the rotor cavity from the bearing cavity in response to a lower rotor cavity pressure.

18. The exhaust gas recirculation pump system of claim 16 wherein the inlet port and the outlet port include an angled geometry.

19. The exhaust gas recirculation pump system of claim 16, wherein the transmission housing includes an oil path formed therein, the oil path including oil inlets extending to oil outlets, said oil inlets and oil outlets coupled to an engine oil circulation system, wherein the oil path lubricates bearings and a transmission assembly.

20. The exhaust gas recirculation pump system of claim 19, wherein the bearings include a spacer assembly positioned in a bearing bore between the bearings, the spacer assembly including an inner spacer spaced radially from an outer spacer.

21. The exhaust gas recirculation pump system of claim 20 wherein the outer spacer includes notches formed therein allowing two way oil flow into and out of the bearings.

22. The exhaust gas recirculation pump system of claim 16, wherein the housing includes a bushing attached thereon, the bushing positioned to support an inner diameter of a hole bored in one of the rotors only during a deflection of the rotor.

23. An exhaust gas recirculation EGR pump system for an internal combustion engine comprising:

an EGR gas source;

an electric motor assembly;

a roots device coupled to the electric motor assembly, the roots device including a housing defining an internal volume, wherein the housing includes a radial inlet port receiving the EGR gas source and an outlet port expelling the EGR gas source from the housing;

rotors disposed in the internal volume and connected to the electric motor assembly; and a transmission housing attached to the housing, the transmission housing including journals formed therein receiving bearings that support the rotors on only a single end of the rotors such that the rotors are overhung without bearing support at an opposite end of the rotors, at least when the rotors are in an undeflected condition;

wherein the bearings include a spacer assembly positioned in a bearing bore between the bearings, the spacer assembly including an inner spacer spaced radially from an outer spacer.

24. The exhaust gas recirculation pump system of claim 23 wherein the outer spacer includes notches formed therein allowing two way oil flow into and out of the bearings.

25. The exhaust gas recirculation pump system of claim 23 wherein the transmission housing includes a lip seal disposed therein, the lip seal movable in response to a pressure differential to contact an oil slinger or rotor sealing a rotor cavity from a bearing cavity.

26. The exhaust gas recirculation pump system of claim 25 wherein the lip seal includes a base having a flexible body disposed thereon, the flexible body including a lip portion formed thereon wherein the lip portion does not seal in a normal operating condition.

27. The exhaust gas recirculation pump system of claim 25, wherein the lip seal includes a base having a flexible body disposed thereon, the flexible body including a lip portion formed thereon, wherein the lip portion seals on the oil slinger or rotor sealing the rotor cavity from the bearing cavity in response to a lower rotor cavity pressure.

28. The exhaust gas recirculation pump system of claim 23, wherein the housing includes a bushing attached thereon, the bushing positioned to support an inner diameter of a hole bored in one of the rotors only during a deflection of the rotor.

29. An exhaust gas recirculation EGR pump system for an internal combustion engine comprising:

an EGR gas source;

an electric motor assembly;

a roots device coupled to the electric motor assembly, the roots device including a housing defining an internal volume, wherein the housing includes a radial inlet port receiving the EGR gas source and an outlet port expelling the EGR gas source from the housing;

rotors disposed in the internal volume and connected to the electric motor assembly; and a transmission housing attached to the housing, the transmission housing including journals formed therein receiving bearings that support the rotors on only a single end of the rotor, and wherein the housing includes a bushing attached thereon, the bushing positioned to support an inner diameter of a hole bored in the rotor only during a deflection of the rotor.

* * * * *